US005195193A

United States Patent [19]

Magistretti

[11] Patent Number: 5,195,193

[45] Date of Patent: Mar. 23, 1993

[54] SOFA WITH TRAVERSABLE SEAT SUPPORT FRAME FOR CONVERSION TO A SINGLE BED

[75] Inventor: Vico Magistretti, Milan, Italy

[73] Assignee: Flou S.p.A., Milan, Italy

[21] Appl. No.: 856,539

[22] Filed: Mar. 24, 1992

[30] Foreign Application Priority Data

Apr. 11, 1991 [IT] Italy ..... MI91 U 000318

[51] Int. Cl.[5] ..... A47C 17/13

[52] U.S. Cl. ..... 5/18.1; 5/17; 5/21

[58] Field of Search ..... 5/17, 18.1, 21, 59.1

[56] References Cited

U.S. PATENT DOCUMENTS

| | | | |
|---|---|---|---|
| 2,436,546 | 2/1948 | Binenkorb | 5/18.1 |
| 2,548,570 | 4/1951 | Udd . | |
| 2,943,333 | 7/1960 | Blecker et al. | 5/18.1 |
| 3,027,570 | 4/1962 | Kamp | 5/17 |
| 3,123,836 | 3/1964 | Bendell . | |
| 3,167,788 | 2/1965 | Muphy et al. | 5/17 |
| 3,284,813 | 11/1966 | Sevcik | 5/17 |
| 3,571,825 | 3/1971 | Bendell . | |
| 3,813,709 | 6/1974 | Friedman | 5/18.1 X |
| 3,896,512 | 7/1975 | Black | 5/17 |
| 4,166,299 | 9/1979 | DuShane et al. | 5/18.1 |

FOREIGN PATENT DOCUMENTS

| | | |
|---|---|---|
| 453364 | 6/1913 | France . |
| 2519532 | 7/1983 | France . |

*Primary Examiner*—Michael F. Trettel
*Attorney, Agent, or Firm*—Herbert Dubno; Yuri Kateshov

[57] ABSTRACT

A convertible sofa includes a rectangular supporting frame provided with a supporting feet resting on the floor and with rigid vertical perimeter structures forming the back and arms, two pairs of rectilinear guides parallel to each other and carrying the arms on the traverse sides, between each pair of slides are mounted free-running rollers with horizontal axes capable of supporting and guiding a respective bar-shaped member which is freely slidable between the pairs parallel guides and which are integral at their front ends with a longitudinal bar provided with supporting wheels resting on the floor so as to enable two stable positions, one of which corresponds to a single bed position.

5 Claims, 2 Drawing Sheets

SOFA WITH TRAVERSABLE SEAT SUPPORT FRAME FOR CONVERSION TO A SINGLE BED

SPECIFICATION FIELD OF THE INVENTION

The present invention relates to a convertible sofa provided with a horizontally slidable sofa support frame, so that the seat may also be used as a bed.

BACKGROUND OF THE INVENTION

There are many known types of an upholstered sofa with a supporting structure provided with cushions forming the seat, the back and, in certain cases, also the side walls of the arms constructed in such a way that they can be converted to beds.

Generally, in order to use these sofas as single beds, it is necessary to remove the cushions so that it will be possible to use the supporting surface which is sprung or elastically yielding as a support for a mattress. A bed is finally prepared after the rearrangement of a mattress and is not convenient because of the presence of the fixed structure of the back along one side of the supporting surface and of the arms, also fixed, on the opposite ends of the said supporting surface. These fixed lateral structures create inconvenience for a user of the bed.

Sofas and armchairs which may be converted into single or double beds by turning over a movable part of the seat with respect to a fixed part in such a way as to obtain a horizontal surface usable for the superimposition of the mattress or mattresses are also known. These designs are of a complex and heavy structure, and almost always require the initial movement of the sofa away from the wall against which it is normally placed with more than a negligible amount of a physical effort.

OBJECTS OF THE INVENTION

It is therefore a principal object of the invention to provide a sofa having two or three stating places constructed in such a way as to enable the seat to occupy, at least, a stable seating and lying position. Still another object is to provide the sofa with the whole available surface of the seat exposed in the lying position, corresponding to a single bed located at such a distance from the back and from the associated lateral arms as to avoid impediments or restrictions for the user.

Yet another object of the invention is to provide a sofa with a seat support surface capable of being moved between the seating and lying positions in a convenient way, without requiring excessive effort or special tools, and capable of permitting the conversion without requiring the preliminary movement of the sofa from its initial position.

A further object of the invention is to provide a sofa with a pull-out seat having high stability in both positions without use of spring means of returning or of locking and unlocking devices in both positions.

SUMMARY OF THE INVENTION

These problems are solved according to the present invention with a sofa having a traversable seat to enable it to be used as a single bed and including a rectangular support frame provided with supporting feet and with rigid perimeter structures forming the back and arms within the frame are disposed two pairs of rectilinear guides which are parallel to each other and carrying the arms on the sides. Between each of the pairs are mounted sets of free-running rollers with horizontal axes, on which is positioned and guided a freely traversable bar-shaped member. The two bar-shaped members are traversable between the parallel guides and being integral at their front ends with a transverse bar provided with supporting wheels resting on the floor, so that the guides and bar form a frame which may be pulled out in a direction perpendicular to the back. The pull-out frame is rigidly secured to the rectangular frame carrying the seat of the sofa so as to enable the sliding frame to be pulled out to a stable position further from the back, thereby enabling the seat to be used as a single bed.

According to the invention, it is also provided that each of the pairs of parallel guides consists of two members in sheet form which are to face each other in the vertical direction. The free-running rollers with horizontal axes are provided with end flanges of a greater diameter and are disposed at a distance from each other in the horizontal direction so as to form means of sliding and guiding as well as means for retention in both the vertical and the transverse directions for the bar-shaped members forming the pull-out frame.

More particular, the bar-shaped members preferably consist of box sections positioned on the free-running rollers in such a way as to remain guided within the end flanges with the additional formation, on the lower surfaces of the sections of hollows in the form of an arc of a circle having a radius substantially equal to that of the roller located near to the front longitudinal side of the sofa. The hollows form stable stopping means for the pull-out frame when they engage with the front rollers either in the pulled-out frame position or in the pushed-in sofa position.

BRIEF DESCRIPTION OF THE DRAWING

The above and further objects, characteristics and advantages of the present invention will be more clearly understood from the following description. References are being made to the accompanying drawings, in which.

SPECIFIC DESCRIPTION

Figure 1:
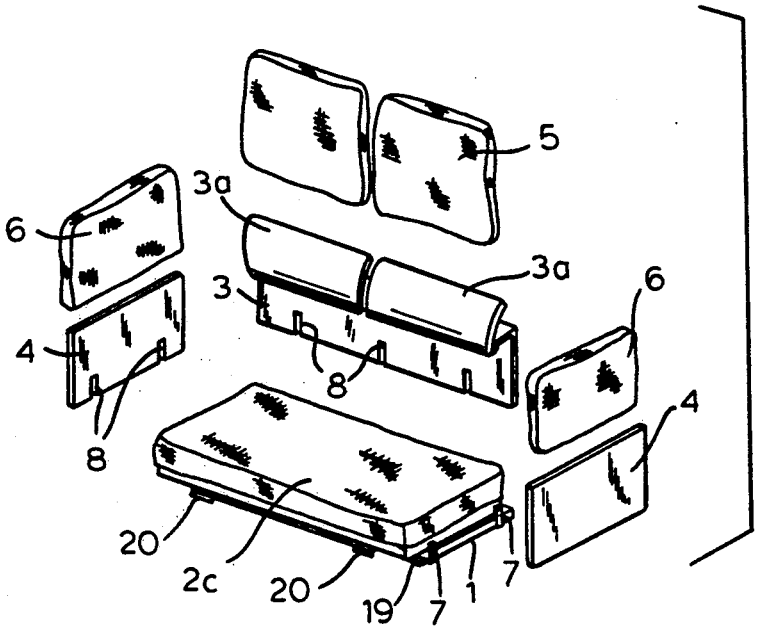
FIG. 1 is an exploded view of the sofa according to the present invention.
Figure 2:
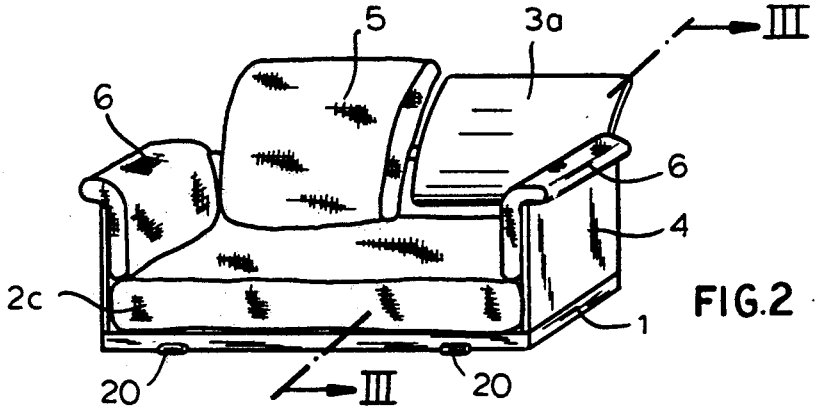
FIG. 2 is a perspective view of the sofa according to FIG. 1 in assembled form.

The sofa comprises substantially a fixed rectangular supporting frame 1 on which is arranged an upholstered cushion 2c which may be fixed or removable; to the longitudinal side of the frame there is secured a back 3 having a rigid sheet form, which is bent forward in its upper part towards the seat and then curved back in such a way as to form two equal-sized and elastically yielding headrests 3a. To the opposite short sides of the supporting frame 1 there are secured by insertion two rigid flat members 4 forming the supports for the arms. Upholstered cushions, indicated by 5 and 6 respectively in FIG. 1, are positioned against the back and the members forming the arms. For the stable but removable support of the back and arms there is provided an axial insertion system consisting of vertical uprights 7 integral with the fixed supporting frame 1 which may be inserted into grooves 8 formed in the inner parts of the back and arms. The transverse cross section of the uprights 7 and of the grooves 8 may be of a tubular or prismatic form, for example, a dovetail.

Figure 4:
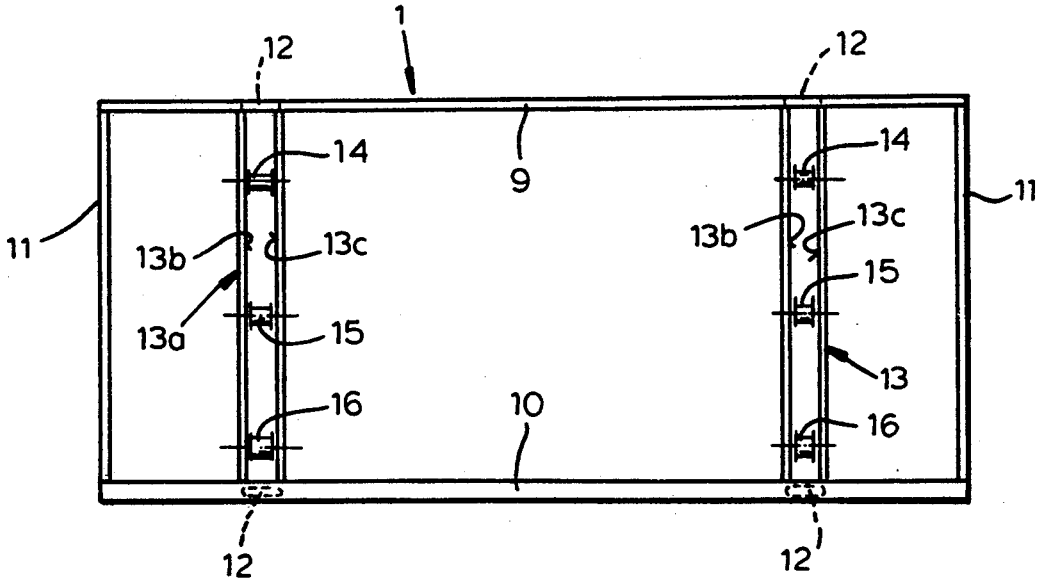
FIG. 4 is a plan view of part of the frame through which passes the plane of the transverse section along III—III in FIG. 2.
Figure 3B:
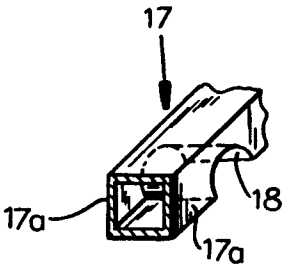
FIG. 3B is a detail perspective view of a guide bar.
Figure 3A:
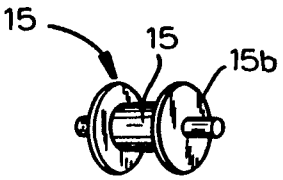
FIG. 3A is a detail perspective view of a roller according to the invention.
Figure 3:
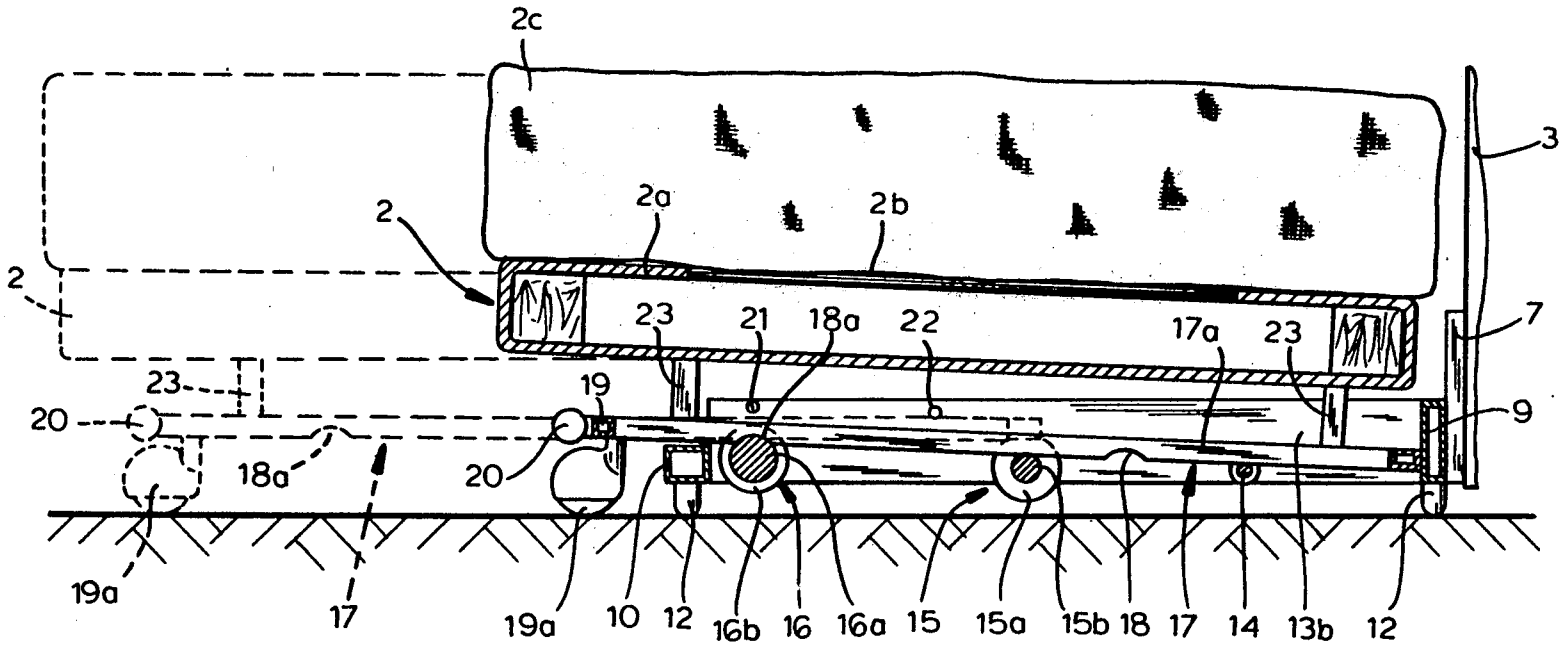
FIG. 3 is a transverse sectional view of the sofa according to FIG. 2 along lines III—III in FIG. 2.

In order to enable the sofa to be used as a single bed without the back and arms, there is provided, according to the present invention, a special structure supporting the seat, this structure being illustrated in detail in FIGS. 3 and 4.

The structure comprises a fixed supporting frame, indicated as a whole by 1 in FIGS. 1-4, of rectangular form, consisting of four box sections indicated respectively by 9 forming the rear longitudinal side with which are associated (FIG. 3) the uprights 7 supporting the back 3, by 10 forming the front longitudinal side, and by 11 (FIG. 4) forming the two opposite transverse sides.

The fixed frame 1 is supported by equal-sized feet 12 integral with the longitudinal sections 9 and 10.

Within the fixed frame 1, as illustrated in plan in FIG. 4 and in section in FIG. 3, there are secured two pairs of parallel guides 13 and 13*a*, parallel to each other and to the transverse sides 11, from which they are located at equal distance.

Each guide consists of beams of substantially rectangular section with two vertical walls 13*b* and 13*c*, of which only the side 13*b* is visible in FIG. 3, disposed vertically and parallel to each other, between which are housed three free-running rollers 14, 15 and 16, with horizontal axes, in positions substantially equally spaced along the sides. The roller 14 is located in the proximity of the rear side 9 of the frame 1, and the roller 15 is located in an intermediate position and consists of a circular body 15*a* with the ends of which are made integral two circular coaxial retaining flanges 15*b* (FIG. 3). Similarly, the roller 16, near the front side 10 of the frame, has a roller 16*a* and two coaxial retaining flanges 16*b*.

Additionally, the diameter of the roller 14 is smaller than that of the central roller 15*a* and this in turn is of smaller diameter than that of the central roller 16*a*.

Above the set of free-running rollers present in the two pairs of guides 13 and 13*a* there is located a bar-shaped section 17, made in the form of a quadrangular box-shaped body, as illustrated in the detail in FIG. 3B.

Each bar-shaped section 17 is located on the rollers 14, 15 and 16 in such a way that the edges of the opposite sides 17*a* of the bar-shaped sections are guided by running the bodies 15*a* 16*a* and between the respective pair of flanges 15*b* and 16*b* of the rollers 15 and 16.

Owing to the difference in diameter between rollers 14-15 and 16, the two bar-shaped sections 17 are caused to slope downwards with respect to the supporting surface 1 from the front longitudinal side to the rear one of the frame 1 (FIG. 3). Additionally, on the lower longitudinal edges of the sides 17*a* of each section 17 there are formed two hollows 18 and 18*a* having a radius of curvature substantially equal to that of the front free-running roller 16, whose function will be explained subsequently.

The two slidable bar-shaped sections 17 are also joined together and stiffened by a transverse section 19, which connects their ends to the exterior of the front side 10 of the frame 1 (FIG. 3), so that the sections 17 and the bar 19 form a frame, open on the rear side next to the back, which can slide freely on the rollers until it is brought, over a certain section of its length, to the exterior of the frame 1, by traversing perpendicularly to the back 3.

Additionally, the transverse section 19, which joins the slidable sections 17 to the frame, is associated with holdable means 20 in the form of a bar or similar, while above the rollers 15 and 16 of each guide 13 there are provided free-running rollers 12 and 22 respectively, which have the function of retaining in the vertical direction the movable sections 17 during their displacing.

To the section 19 there are secured two castors 19*a*, capable of assisting the outward sliding of the traversable frame and of forming a stable means of support on the ground when the frame is pulled out.

Finally, in the proximity of the opposite ends of the two slidable sections 17 there are provided four uprights 23 (FIG. 3) capable of rigidly supporting the structure forming the seat 2 of the sofa, this seat being possibly formed by a rigid quadrangular frame with its upper surface 2*a* at least partially elastically yielding, as indicated by 2*b* in FIG. 3, for the support of the mattress 2*c*.

FIG. 3 shows, in the continuous lines, the sofa with the pull-out frame in the pushed-in sofa position, in other words with the curved hollow 18*a* resting on the central roller 16*a*, while the broken line shows the same sofa with the seat support frame pulled out in the position of use as a single bed.

The operation to pull out (and push back in) the movable frame supporting the seat is very simple and rapid by taking hold the corresponding means 20, the pull-out frame is raised slightly, in such a way as to enable the sections 17 to disengage the curved hollows 18*a* from the free-running rollers 16*a*, after which the frame is pulled out horizontally until the two rear curved hollows 18 are positioned in stable engagement on the rear rollers 16*a*. In this position, the pull-out frame settles and remains in a stable position by the effect of the support of the castors 19*a* on the floor and the engagement of the frame with the rollers 16*a*. In order to push the pull-out frame back in, the operation is performed in reverse, by slightly raising the bar 20 and exerting a force on the movable frame in the direction of the back until the rear curved hollows 18*a* of the sections 17 are repositioned in engagement with the rear rollers 16*a*.

Evidently, modifications and variations of the sofa with a pull out seat support frame as described above are possible, without departing from the scope of protection of the invention. Similarly, the materials used and the dimensions of the various components may vary as desired or according to requirements.

I claim:

1. A convertible sofa comprising:

a supporting frame having front and rear elongated sides and provided with a plurality of feet resting on a floor;

means forming a vertical rigid back and a pair of vertical rigid arms mounted on said frame; and guide means on said frame for converting the sofa from a sitting position to a resting position corresponding to a bed, said guide means including:

two pairs of rectilinear guides mounted on said frame between said front and rear sides and spaced from one another, each of said pairs being operatively connected with said arms and including respective pair of spaced apart and parallel supports, a respective plurality of spaced apart rollers mounted between each two supports of the respective pair of said guides and freely rotatable about respective axes extending parallel to said front side of said supporting frame, at least one roller of each of said pluralities being formed with a respective shaft flanked on opposite sides thereof with a pair of flanges each extending radially outwardly from the shaft, a pair of bar members each slidably mounted on the respective plurality of rollers and having a respective front end, and a transverse elongated bar bridging said front ends, said bar members and said transverse bar forming a displaceable frame for supporting a sofa seat slidable between a pull-in position corresponding to the sitting position and pull-out position corresponding to the resting position of the sofa, said transverse bar being provided with supporting wheels resting on the floor and with holding means for manually displacing said displaceable frame between said pull-in and pull-out positions.

2. The convertible sofa defined in claim 1 wherein each of said bar members is guided between said flanges of the respective roller.

3. The convertible sofa defined in claim 1 wherein said guide means further comprising a plurality of uprights mounted on respective bar members and supporting the seat of said sofa.

4. The convertible sofa defined in claim 1 wherein each of said plurality of rollers includes at least three rollers, the shafts of respective rollers mounted next to front and rear elongated sides of said supporting frame having respectively largest and smallest diameters, the roller mounted next to said rear side being formed without said flanges, so that said displaceable frame being inclined angularly rearwardly in said pull-in position and extending horizontally in said pull-out position.

5. A convertible sofa comprising:

a supporting frame having front and rear elongated sides and provided with means forming a plurality of feet resting on a floor;

means forming a vertical rigid back and a pair of vertical rigid arms mounted on said frame; and guide means on said frame for converting the sofa from a sitting position to a resting position corresponding to a bed, said guide means including:

two pairs of rectilinear guides mounted on said frame between said front and rear sides and spaced from one another a respective plurality of spaced apart rollers mounted on each pair of said guides and freely rotatable about respective axes extending parallel to said front side of said supporting frame, a pair of bar members each slidably mounted on the respective plurality of rollers and having a respective front end, and a transverse elongated bar bridging said front ends and forming a displaceable frame supporting a sofa seat, said displaceable frame being guided along the respective plurality of rollers between a pull-in position corresponding to the sitting position and pull-out position corresponding to the resting position of the sofa, each of said bar members being provided with respective means forming a plurality of arcuate recesses each extending upwardly and formed with a respective radius sufficient to engage rollers mounted next to said front side of said supporting frame in said pull-in and pull-out positions, said transverse bar being provided with supporting wheels resting on the floor and with holding means for manually displacing said displaceable frame between said pull-in and pull-out positions.

* * * * *